US007334992B2

(12) United States Patent
Downs et al.

(10) Patent No.: US 7,334,992 B2
(45) Date of Patent: Feb. 26, 2008

(54) TURBINE BLADE COOLING SYSTEM

(75) Inventors: James P. Downs, Jupiter, FL (US); Norman F. Roeloffs, Tequesta, FL (US); Edward F. Pietraszkiewicz, Southington, CT (US)

(73) Assignee: United Technologies Corporation, Hartford, CT (US)

( * ) Notice: Subject to any disclaimer, the term of this patent is extended or adjusted under 35 U.S.C. 154(b) by 102 days.

(21) Appl. No.: 11/140,786

(22) Filed: May 31, 2005

(65) Prior Publication Data

US 2006/0269410 A1 Nov. 30, 2006

(51) Int. Cl.
*F01D 5/18* (2006.01)

(52) U.S. Cl. ..... 416/97 R

(58) Field of Classification Search ..... 415/115; 416/97 R

See application file for complete search history.

(56) References Cited

U.S. PATENT DOCUMENTS 3,240,468 A * 3/1966 Watts et al. ..... 415/115
4,183,716 A * 1/1980 Takahara et al. ..... 416/96 A
4,297,077 A * 10/1981 Durgin et al. ..... 416/97 R
4,770,608 A * 9/1988 Anderson et al. ..... 416/97 R
5,246,341 A 9/1993 Hall et al.
5,498,133 A * 3/1996 Lee ..... 416/97 R
5,603,606 A 2/1997 Glezer et al.
5,688,104 A 11/1997 Beabout
5,702,232 A 12/1997 Moore
5,931,638 A * 8/1999 Krause et al. ..... 416/97 R
5,975,851 A 11/1999 Liang
6,139,269 A 10/2000 Liang
6,206,638 B1 * 3/2001 Glynn et al. ..... 416/97 R
6,234,754 B1 5/2001 Zelesky et al.

* cited by examiner

*Primary Examiner*—Igor Kershteyn

(57) ABSTRACT

A turbine blade cooling system for a gas turbine engine includes a turbine blade having a trailing edge, a concave side, and a convex side. The trailing edge defines at least one set of impingement holes each having a central longitudinal axis which is closer to a nearest portion of an edge of the blade at one of the concave and convex sides relative to a nearest portion of an edge of the blade at the other of the concave and convex sides. Alternatively or in addition to the foregoing, the trailing edge can define at least one set of impingement holes each having a central longitudinal axis which is angled in a direction of a flow of cooling medium toward one of the concave and convex sides relative to the other of the concave and convex sides.

9 Claims, 2 Drawing Sheets

TURBINE BLADE COOLING SYSTEM

FIELD OF THE INVENTION

This invention relates generally to turbine blades for gas turbine engines, and more particularly to turbine blade cooling systems.

BACKGROUND OF THE INVENTION

The trailing edges of turbine blades for gas turbine engines are often cooled using an impingement heat transfer system. The impingement system works by accelerating a flow through an orifice and then directing this flow onto a downstream surface to impinge upon a desired heat transfer surface. When applied to the trailing edge of a cooled turbine airfoil, the system typically assumes the form of a group of crossover holes in one or more ribs. Cooling flow is accelerated from the upstream cavity, which is maintained at high pressure on one side of the rib to the impingement cavity, which is maintained at lower pressure on the other side of the rib. An example of such a trailing edge impingement cooling system is depicted in FIGS. 1 and 2. In this particular example, two impingement cooling systems are employed in a series arrangement. As shown in FIG. 1, a turbine blade indicated generally by the reference number 10 defines a first feed cavity 12 and a second feed cavity 14 connected in series. The second feed cavity 14 communicates with first and second transition chambers 16, 18 defined by the blade 10 at a transition region to supply an impinging jet of a cooling medium through the transition chambers and to an ejection slot 22 defined by the blade at a trailing edge region 24 thereof. The overall impingement cooling system can include any arrangement of independent impingement cooling systems or multiples thereof combined in series or in parallel with one another.

The impingement cooling system facilitates cooling of the trailing edge region 24 by promoting convective heat transfer between the cooling medium and the internal walls of the component. Convective cooling is promoted both within the impingement cavity itself and also within impingement holes.

In the typical trailing edge impingement cooling system, a set of impingement holes is typically centered along a central longitudinal axis of a set of impingement ribs defining the impingement holes. This is due, in part, to perceived constraints of the investment casting process, which is used to fabricate the part, and also to focus the impinged flow on a particular downstream target surface. With the impingement holes located centrally within the impingement ribs, the propensity to cool the concave and convex surfaces of the airfoil via convection into the impingement holes are relatively consistent because the conductive resistances are essentially the same in either direction.

As best shown in FIG. 2, the turbine blade 10 including a conventional trailing edge impingement system has a first set of impingement holes 26 defined by impingement ribs coupling the second feed cavity 14 and the first transition chamber 16, and a second set of impingement holes 28 defined by impingement ribs coupling the first transition chamber 16 and the second transition chamber 18. As shown in FIG. 2, the impingement holes 26, 28 each have a central longitudinal axis extending in a direction of airflow which generally coincides with a localized central longitudinal axis of the impingement ribs or of blade 10. In other words, the first and second sets of impingement holes 26, 28 each have a central longitudinal axis which is generally equidistant from a nearest portion of an edge 30 of the blade at a convex side 31 and a nearest portion of an edge 32 of the blade at a concave side 33. As a result, a conduction resistance 34 on a concave side of the blade 10 is generally equal to a conduction resistance 36 on a convex side of the blade.

The problem with prior trailing edge impingement cooling systems involves cooling of the airfoil concave and convex sides by impinging jets of a cooling medium when the heating from the two sides is substantially unequal. For example, the heat load imposed on the concave (pressure) side of an airfoil can be much greater than that imposed in the convex (suction) side because of the influences of accelerating flows, roughness and deleterious film cooling effects such as accelerated film decay characteristics on the concave side.

Accordingly, it is an object of the present invention to provide a trailing edge impingement cooling system for a turbine blade of a gas turbine engine that overcomes the above-mentioned drawbacks and disadvantages.

SUMMARY OF THE INVENTION

In one aspect of the present invention, a turbine blade cooling system for a gas turbine engine includes a turbine blade having a trailing edge, a concave side, and a convex side. The trailing edge defines at least one set of impingement holes each having a central longitudinal axis which is closer to a nearest portion of an edge of the blade at one of the concave and convex sides relative to a nearest portion of an edge of the blade at the other of the concave and convex sides.

In another aspect of the present invention, a turbine blade cooling system for a gas turbine engine includes a turbine blade having a trailing edge, a concave side, and a convex side. The trailing edge defines at least one set of impingement holes each having a central longitudinal axis which is angled in a direction of a flow of cooling medium toward one of the concave and convex sides relative to the other of the concave and convex sides.

DETAILED DESCRIPTION OF THE PREFERRED EMBODIMENTS

Figure 1:
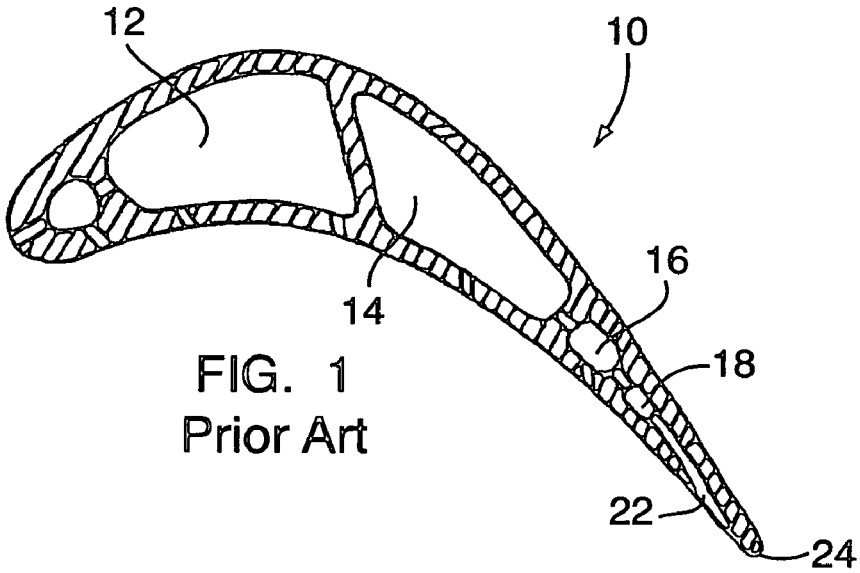
FIG. 1 Prior Art
FIG. 1 is a cross-sectional plan view of a turbine blade including a trailing edge cooling system.
Figure 2:
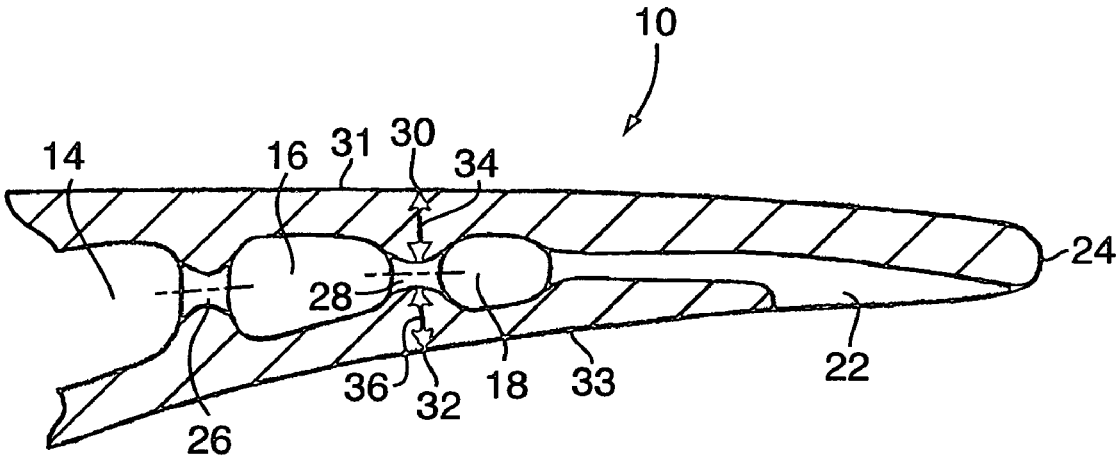
FIG. 2 Prior Art
FIG. 2 is an enlarged cross-sectional plan view of the turbine blade of FIG. 1.
Figure 3:
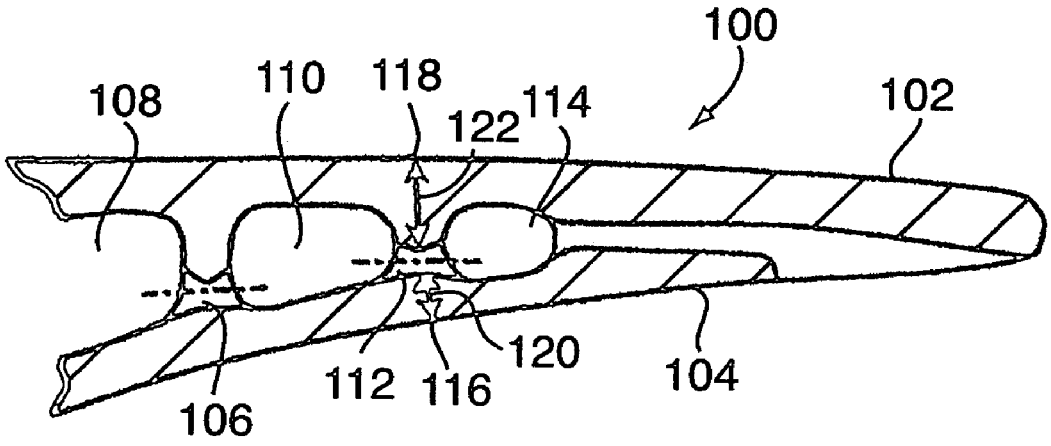
FIG. 3 is an enlarged cross-sectional plan view of a turbine blade including a trailing edge cooling system in accordance with the present invention.

Referring to FIG. 3, a turbine blade having a trailing edge cooling system embodying the present invention is indicated generally by the reference number 100. The turbine blade 100 has an internal convection cooling system configured to accommodate a higher heat load imposed on a concave side 104 of the blade relative to a convex side 102 of the blade. The turbine blade 100 by way of example only is similar to the turbine blade 10 of FIG. 2 except for the location of impingement holes within the blade as explained more fully below. However, it should be understood that other features of the blade such as the number and location of feed cavities, transition chambers and ejection slots can vary without departing from the scope of the present invention.

With reference to FIG. 3, the turbine blade 100 has a first set of impingement holes 106 defined by impingement ribs coupling a second feed cavity 108 and a first transition chamber 110, and a second set of impingement holes 112 defined by impingement ribs coupling the first transition chamber 110 and a second transition chamber 114. The impingement holes 106, 112 each have a central longitudinal axis extending in a direction of a flow of cooling medium which is offset relative to a localized central longitudinal axis of the blade 100. The first and second sets of impingement holes 106, 112 each have a central longitudinal axis which is closer to a nearest portion of an edge of either the concave side 104 or the convex side 102 relative to the nearest portion of an edge of the blade at the other of the sides. As shown in FIG. 3, for example, the first and second sets of impingement holes 106, 112 each have a central longitudinal axis which is closer to a nearest portion of an edge 116 of the blade 110 at the concave side 104 relative to a nearest portion of an edge 118 of the blade at the convex side 102. As a result, a conduction resistance 120 on the concave side 104 of the blade 100 is less than that of a conduction resistance 122 on the convex side 102 of the blade.

In other words, the impingement holes 106, 112 are biased or disposed to one side of the blade 100. Offsetting the impingement holes 106, 112 in this manner affects the conductive resistance between the impingement holes and external surfaces to be cooled by impinging jets of a cooling medium. Specifically, the impingement holes 106, 112 are offset toward the concave side 104 in order to compensate for the additional heat load that would otherwise be generated on the concave side 104 relative to the convex side 102. The offset impingement holes 106, 112 thus cause the edge 116 on the concave side 104 and the edge 118 on the convex side 102 of the blade 100 to operate at more uniform temperatures relative to each other. The impinging jets of cooling medium are focused in a direction which is generally perpendicular to the impingement rib angle.

Figure 4:
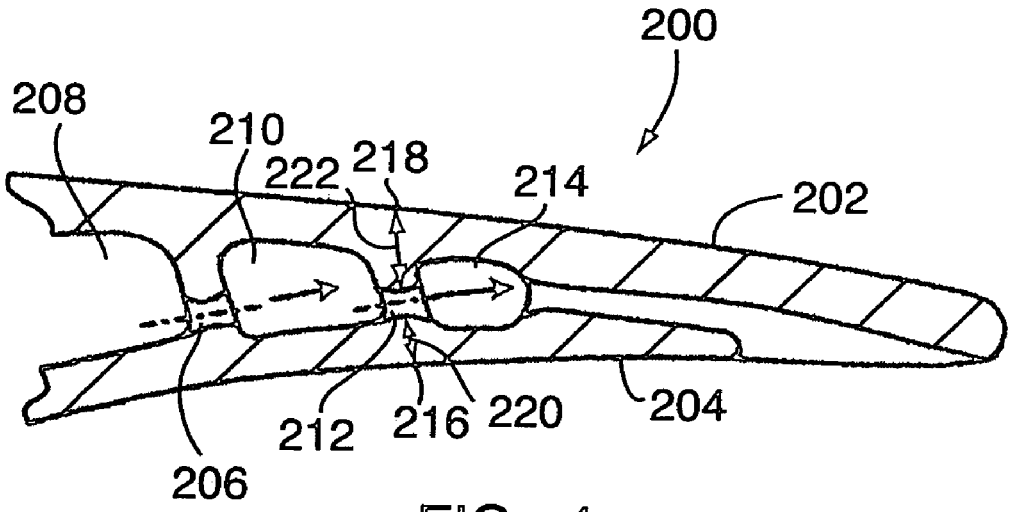
FIG. 4 is an enlarged cross-sectional plan view of a turbine blade including a trailing edge cooling system in accordance with a second embodiment of the present invention.

Referring to FIG. 4, a turbine blade having a trailing edge cooling system in accordance with a second embodiment of the present invention is indicated generally by the reference number 200. The turbine blade 200 has an internal convection cooling system configured to accommodate a higher heat load imposed on a convex side 202 of the blade 200 relative to a concave side 204 of the blade.

With reference to FIG. 4, the turbine blade 200 has a first set of impingement holes 206 defined by impingement ribs coupling a second feed cavity 208 and a first transition chamber 210, and a second set of impingement holes 212 defined by impingement ribs coupling the first transition chamber 210 and a second transition chamber 214. The impingement holes 206, 212 each have a central longitudinal axis extending in a direction of a flow of cooling medium which is offset to one or the other side of the blade 200 relative to a localized central longitudinal axis of the blade 200. As shown in FIG. 4, for example, the first and second impingement holes 206, 212 each have a central longitudinal axis which is closer to a nearest portion of an edge 216 of the blade 200 at the concave side 204 relative to a nearest portion of an edge 218 of the blade at the convex side 202. As a result, a conduction resistance 220 on the concave side 204 of the blade 200 is less than that of a conduction resistance 222 on the convex side 202 of the blade.

In other words, the impingement holes 206, 212 are biased or disposed to one side of the blade 200. Offsetting the impingement holes 206, 212 in this manner affects the conductive resistance between the impingement holes and external surfaces to be cooled by impinging jets of a cooling medium. Specifically, the impingement holes 206, 212 are offset toward the concave side 204 in order to compensate for the additional heat load that would otherwise be generated on the concave side 204 relative to the convex side 202. The offset impingement holes 206, 212 thus cause the edge 216 on the concave side 204 and the edge 218 on the convex side 202 of the blade 200 to operate at more uniform temperatures relative to each other. The impinging jets of cooling medium are focused in a direction which is generally perpendicular to the impingement rib angle.

Moreover, the impingement ribs defining the impingement holes 206, 212 can be angled such that a central longitudinal axis of the impingement holes are also angled in a direction of a flow of cooling medium slightly toward one side of the turbine blade 200 relative to the other side in order to further refine and optimize a target of the impinging jets of cooling medium. As shown in FIG. 4, for example, the central longitudinal axis of the impingement holes are angled in a direction of a flow of cooling medium slightly toward the convex side 202 relative to the concave side 204. Although the impingement holes having an angled central longitudinal axis, as shown and described with respect to FIG. 4, are also shown and described as being offset, it should be understood that the angled impingement holes can also be non-offset without departing from the scope of the present invention.

As will be recognized by those of ordinary skill in the pertinent art, numerous modifications and substitutions can be made to the above-described embodiment of the present invention without departing from the scope of the invention. Accordingly, the preceding portion of this specification is to be taken in an illustrative, as opposed to a limiting sense.

What is claimed is:

1. A turbine blade cooling system, comprising a turbine blade having a trailing edge, a concave side, and a convex side, feed and transition cavities disposed generally medially of and bounded by said concave and convex sides of said turbine blade in said trailing edge, at least one set of impingement holes disposed in a rib separating said feed and transition cavities such that cooling air supplied to said feed cavity flows through each of said impingement holes to cool both said concave and convex sides of said turbine blade, each impingement hole having a central longitudinal axis which is closer to a nearest portion of an edge of the blade at one of the concave and convex sides relative to a nearest portion of an edge of the blade at the other of the concave and convex sides wherein cooling of said one side relative to said other side is enhanced by the closeness of said impingement holes to said one side.

2. A turbine blade cooling system as defined in claim 1, wherein the central longitudinal axis of each of the at least one set of impingement holes is angled in a direction of a flow of cooling medium toward one of the concave and convex sides relative to the other of the concave and convex sides.

3. A turbine blade cooling system as defined 1, wherein the at least one set of impingement holes each has a central longitudinal axis which is closer to a nearest portion of an edge of the blade at the concave side relative to a nearest portion of an edge of the blade at the convex side.

4. A turbine blade cooling system as defined in claim 1, wherein the central longitudinal axis of each of the at least one set of impingement holes is angled in a direction of a flow of cooling medium toward the convex side relative to the concave side of the turbine blade.

5. A turbine blade cooling system as defined in claim 1, wherein the turbine blade further defines first and second transition chambers, the at least one set of impingement holes including a first set of impingement holes coupling the feed cavity with the first transition chamber, and including a second set of impingement holes coupling the first transition chamber with the second transition chamber.

6. A turbine blade cooling system, comprising a turbine blade having a trailing edge, a concave side, and a convex side, feed and transition cavities disposed generally medially of and bounded by said concave and convex sides of said turbine blade in said trailing edge, at least one set of impingement holes disposed in a rib separating said feed and transition cavities such that cooling air supplied to said feed cavity flows through each of said impingement holes to cool both said concave and convex sides of said turbine blade, each impingement hole having a central longitudinal axis which is angled in a direction of a flow of cooling medium toward one of the concave and convex sides relative to the other of the concave and convex sides wherein cooling of said one side relative to said other side is enhanced by the closeness of said impingement holes to said one side.

7. A turbine blade cooling system as defined in claim 6, wherein the at least one set of impingement holes each has a central longitudinal axis which is angled in a direction of a flow of cooling medium toward the convex side relative to the concave side.

8. A turbine blade cooling system as defined in claim 7, wherein the turbine blade further defines first and second transition chambers, the at least one set of impingement holes including a first set of impingement holes coupling the feed cavity with the first transition chamber, and including a second set of impingement holes coupling the first transition chamber with the second transition chamber.

9. A turbine blade cooling system, comprising a turbine blade having a trailing edge, a concave side, and a convex side, feed and transition cavities disposed generally medially of and bounded by said concave and convex sides of said turbine blade in said trailing edge, at least one set of impingement holes disposed in a rib separating said feed and transition cavities such that cooling air supplied to said feed cavity flows through each of said impingement holes to cool both said concave and convex sides of said turbine blade, each impingement hole having a central longitudinal axis which is closer to a nearest portion of an edge of the blade at the concave side relative to a nearest portion of an edge of the blade at the convex side wherein cooling of said one side relative to said other side is enhanced by the closeness of said impingement holes to said one side.

* * * * *